US006629852B2

(12) United States Patent
Mori et al.

(10) Patent No.: US 6,629,852 B2
(45) Date of Patent: Oct. 7, 2003

(54) RELAY SOCKET

(75) Inventors: Toshinari Mori, Kyoto (JP); Keisuke Yano, Kyoto (JP); Keisuke Arita, Ohita (JP)

(73) Assignee: Omron Corporation, Kyoto (JP)

( * ) Notice: Subject to any disclaimer, the term of this patent is extended or adjusted under 35 U.S.C. 154(b) by 11 days.

(21) Appl. No.: 09/805,881

(22) Filed: Mar. 15, 2001

(65) Prior Publication Data

US 2002/0132504 A1 Sep. 19, 2002

(51) Int. Cl.[7] ..... H01R 13/62
(52) U.S. Cl. ..... 439/160; 439/153; 439/491
(58) Field of Search ..... 439/160, 153, 439/157, 155, 491, 488, 152

(56) References Cited

U.S. PATENT DOCUMENTS 5,108,298 A * 4/1992 Simmel ..... 439/160
5,613,874 A * 3/1997 Orlando et al. ..... 439/491
6,361,335 B1 * 3/2002 Calanni et al. ..... 439/152

OTHER PUBLICATIONS

OMRON Publication "PYF14S" pp. 1–18.

* cited by examiner

*Primary Examiner*—Renee Luebke
*Assistant Examiner*—Felix O. Figueroa
(74) *Attorney, Agent, or Firm*—Morrison & Foerster LLP

(57) ABSTRACT

It is an object of the invention to provide an ejector mechanism and a socket which are free from fear of breakage and in which a smooth and reliable pulling out operation can be obtained.

In the invention, an ejector mechanism includes an ejector having: an ejector which is interposed between the socket body and an attachment face of the relay, and in which a part of an arcuate face is in contact with an attachment face of the relay; and tilting enabling means, journalled on the socket body, for gradually displacing a contact position between the pushing-up curved face and the attachment face of the relay with using the journal portion as a tilting fulcrum, and, when the tilting enabling means performs a tilting operation, the contact position of the pushing-up curved face is moved in a pushing-up direction along which the relay is separated from the socket body, with using the journal portion as a tilting fulcrum.

9 Claims, 16 Drawing Sheets

RELAY SOCKET

FIELD OF THE INVENTION

The present invention relates to an ejector mechanism which is used for detaching, for example, a relay such as a small switch or a multipolar socket, and more particularly to an ejector mechanism and a socket in which the relay handling performance is enhanced so that a relay can be easily detached from the relay body.

BACKGROUND OF THE INVENTION

In the case where terminals of a relay are inserted into terminal connecting portions of the body of a socket to integrally connect the relay with the socket body, usually, an ejector for removing a relay is interposed between the connecting portions. When the relay is to be detached from the socket because of inspection, replacement, or the like, the ejector is operated to apply an external force in a direction along which the relay is pulled out, whereby the relay is lifted up. Then, the relay is detached from the socket.

In this case, when the relay is to be pulled out from the socket body, "principle of the lever" of the ejector attached to the socket body is used for converting a small operating force applied to the ejector to a large pulling-out force.

In the ejector using "principle of the lever", however, the point of application is configured so that, also during the operation of pulling out the relay, one point is always in contact with the relay to provide the pulling-out force. As the relay begins to be pulled and moved, the contact angle in the point of application is changed during the relay pulling operation. Therefore, the pulling-out force caused by the ejector is applied in a different direction which is slightly tilted from the pulling-out direction. As a result, the load is apt to be concentrated on the point of application of the ejector, and the ejector is therefore liable to be broken.

Relays of the same size and having different number of poles are serialized. As the number of poles to which terminals are to be connected is larger, the force which is required for pulling out the relay is proportionally larger. Consequently, also the tilting operating force which is loaded onto the ejector itself is made larger, so that the point of application of the ejector must have high strength.

In the current circumstance, however, many terminals are concentrically arranged in a limited area. Therefore, the space for placing the point of application of the ejector is restricted, and hence it is impossible to provide the point of application with a shape of sufficient strength. As a result, the ejector is easily broken in the vicinity of the point of application. When such breakage occurs, the detaching operation of the ejector is disabled. Consequently, an ejector mechanism of the conventional art has a problem in that an ejector cannot be sufficiently provided with strength required for pulling out a multipolar relay.

It is an object of the invention to provide an ejector mechanism and a socket which are free from fear of breakage and in which a smooth and reliable pulling out operation can be obtained.

In the invention, attentions has been paid to a configuration in which, during a process of pulling out a relay, the point of application of an ejector using the principle of the lever is gradually displaced. Namely, the invention is configured so that the point of application of an ejector is gradually displaced, whereby a linear force in a direction of pulling out a relay is applied to the relay from beginning to end, and the point of application of the ejector is caused to act always on the relay by a constant force.

SUMMARY OF THE INVENTION

The invention is characterized in that, when a relay is to be pulled out and detached from a socket body, the relay is pulled out by an ejector wherein a pushing-up curved face in which a part of an arcuate face is in contact with an attachment face of the relay is interposed between the socket body and the attachment face of the relay, tilting enabling means for gradually displacing a contact position between the pushing-up curved face and the attachment face of the relay in a direction of tilting which is centered at a journal portion is disposed, and, when the tilting enabling means performs a tilting operation, the contact position of the pushing-up curved face is moved in a pushing-up direction along which the relay is separated from the socket body.

Therefore, the tilting displacement amount of the pushing-up curved face which is operated by tilting displacement is very smaller than the linear pulling-out movement amount in the relay pulling-out direction. As a result, the relay pulling-out direction and the pushing-up direction of the pushing-up curved face can be maintained to substantially coincide with each other.

When a pulling-out force is applied to the relay in accordance with tilting of the ejector, therefore, the pushing-up curved face which corresponds to the point of application of the ejector using the principle of the lever is gradually displaced so as to follow the pulling movement, even after the relay begins to be pulled out in the pulling-out direction. Consequently, the pushing-up direction of the pushing-up curved face and the relay pulling-out direction always coincide with each other, so that a smooth pulling out operation can be obtained. During the process of pulling out the relay, particularly, the point of application is moved from a place which is closer to the tilting fulcrum, to that which is remoter therefrom, and hence the load on the ejector can be reduced.

Furthermore, the contact position of the pushing-up curved face is gradually displaced so that a pulling-out force is applied in the same direction as the direction of pulling out the relay. Therefore, the load on the pushing-up curved face is kept constant and a stable pulling-out force is obtained. Moreover, the pushing-up curved face is mobilly in surface contact with the relay in accordance with the tilting, and the pulling-out angle can be maintained to have the same value from beginning to end. Therefore, the pulling-out load is not locally concentrated, so that stresses such as bending on the terminals can be suppressed to the minimum degree. As a result, it is possible to realize an ejector of high durability which is free from fear of breakage and the like.

Even when a large pulling-out force is required as a result of an increased number of terminals, a linear force can be kept to be applied in the same direction as the direction of pulling out the relay. Therefore, the relay is stably pulled out in a substantially vertical direction, so that, even in the case of an increased number of poles, the performance of pulling-out a relay can be enhanced.

Alternatively, the pushing-up curved face formed on the ejector may be disposed in each of both sides which are opposed to the attachment face of the relay.

According to this configuration, a single relay can be pushed up in balance at the both the sides, whereby the pulling-out force can be uniformly applied to the attachment face of the relay.

A pressing piece for tilting may be formed on an outer end portion of the ejector.

According to this configuration, the ejector is tilted simply by applying a tilting operation on the pressing piece by a finger, and hence the relay can be easily detached from the socket.

The invention provides an ejector mechanism which, when a relay that is attached to a socket body by inserting a plurality of terminals into the socket body is to be detached from the socket body, detaches the relay from the socket body by pulling out the relay, wherein an ejector is interposed between the socket body and an attachment face of the relay, has a pushing-up face which is in contact with the attachment face of the relay, is tiltably journalled on the socket body, and, when the ejector is tilted, pushes up the relay from the socket body by the pushing-up face, and a nameplate is detachably attached to the ejector.

According to the invention, even in the case where many sockets are juxtaposed, when a relay is to be detached from the corresponding socket, for example, the relay can be detached with using a number born on the nameplate as an index. In maintenance, therefore, detachment or attachment of a relay can be performed easily and surely.

When a socket is provided with such an ejector mechanism, an electronic part which is to be connected to the socket, such as a relay, a switch, or a timer can be smoothly attached or detached, thereby facilitating the handling of the part. Consequently, the invention attains effects that the operation performance of attaching and detaching a relay and the performance of protecting an ejector can be improved, and that a socket of high reliability can be used.

DESCRIPTION OF THE PREFERRED EMBODIMENTS

Figure 1:
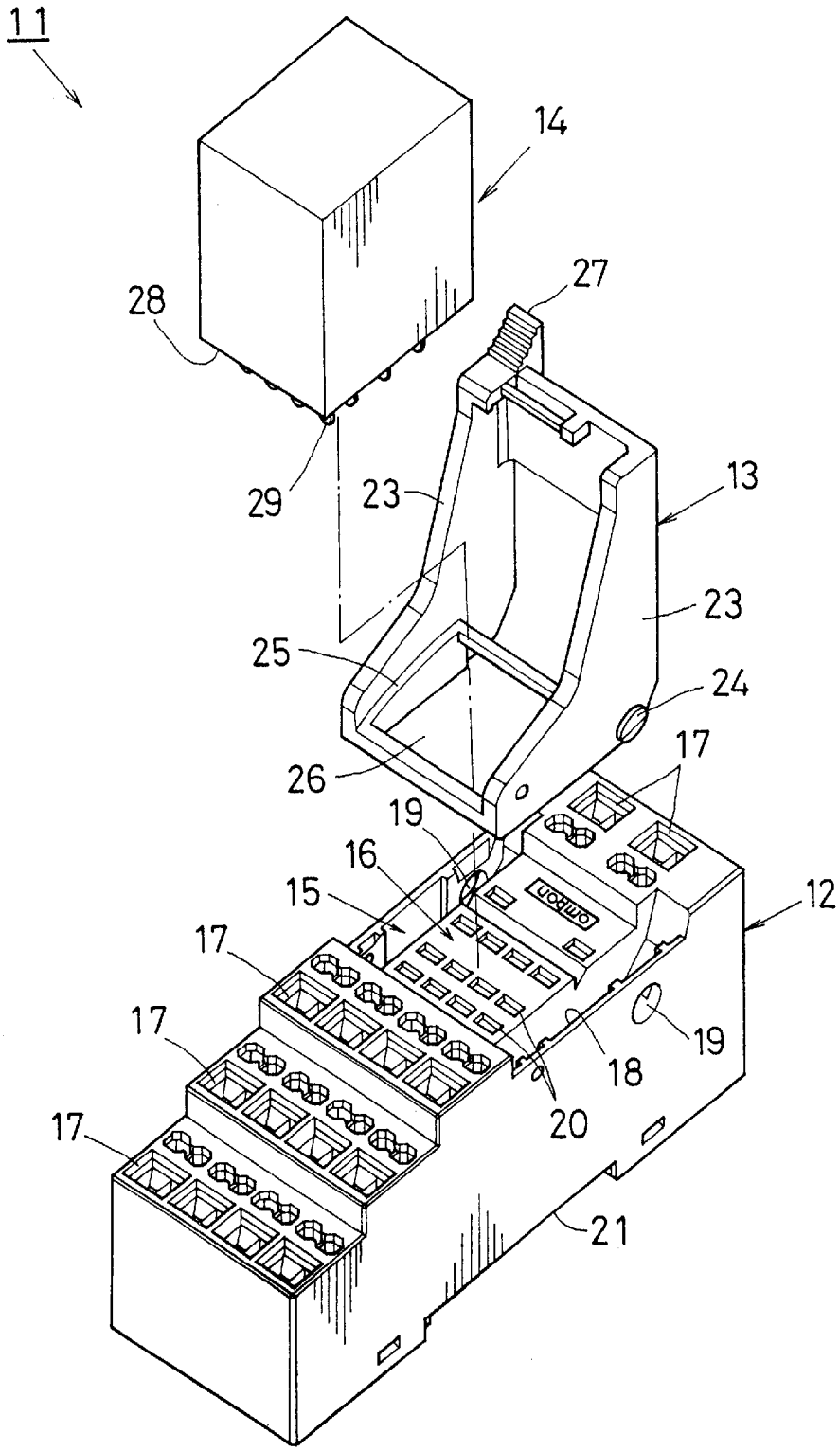
FIG. 1 is an exploded perspective view of a multipolar socket as viewed from the top of a first embodiment of the invention.

Embodiments of the invention will be described in detail with reference to FIGS. 1 to 17 of the accompanying drawings.

In a first embodiment, as shown in FIGS. 1 to 8, the invention is applied to a multipolar (four-pole) socket. In the multipolar socket 11, an ejector 13 is attached to the upper face of the socket body 12 which has a substantially rectangular parallelepiped shape. A relay 14 which is mounted on the socket performs switching operations to close and open a plurality of circuits.

The socket body 12 has an ejector attaching portion 15 and a relay mounting face 16 in a center area of the upper face, and many open connecting portions 17 into which cables are insertingly attached, in both the sides of the upper face in the longitudinal direction.

The ejector attaching portion 15 is configured by an accommodating groove 18 which can accommodate a lower portion of the ejector 13, and which has a substantially U-like shape in a plan view. A journal hole 19 which communicates with the U-like accommodating groove 18 is opened in each of the side faces of the socket body 12. The ejector 13 which will be described later is tiltably journalled by the journal holes 19.

The relay mounting face 16 is formed in a position surrounded by the U-like accommodating groove 18 so as to correspond to the lower face of the relay 14, and has terminal openings 20 which are formed in the upper face with being arranged vertically and laterally (for example, 4 columns×4 rows).

Figure 2:
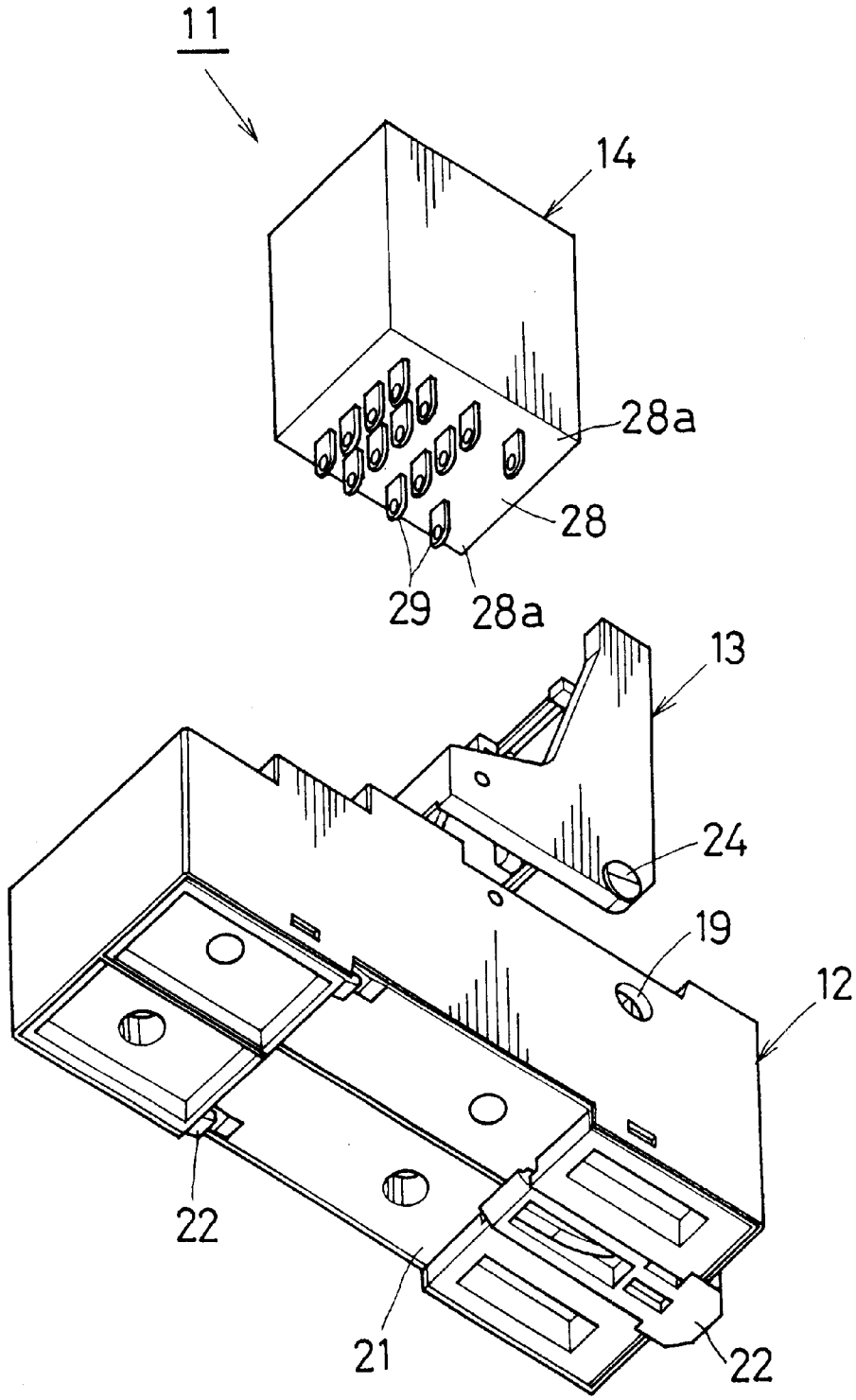
FIG. 2 is an exploded perspective view of the multipolar socket as viewed from the bottom of the first embodiment of the invention.

As shown in FIG. 2, a mounting recess 21 which is cut away in a concave form, and a mounting mechanism 22 are disposed in a center area of the lower face of the socket body 12. The socket body 12 is mounted on a mounting rail of an adequate kind or the like which is not shown, via the mounting recess 21 and the mounting mechanism 22.

The ejector 13 performs an ejector function of pulling out and detaching the relay 14 mounted on the upper face of the socket body 12, from the upper face. In the ejector 13, a journal shaft 24 protrudes from the outer face of each of L-like side plates 23 which are positioned on both the sides of the ejector, respectively. The ejector 13 is accommodated in the U-like accommodating groove 18 of the socket body 12 with leaving a tilting allowable space therebetween. When the journal shafts 24 are respectively journalled by the journal holes 19 of the socket body 12, therefore, the ejector 13 is held with using the journal holes 19 as the tilting fulcrum so as to be tiltable in the longitudinal direction of the socket body 12.

Figure 5:
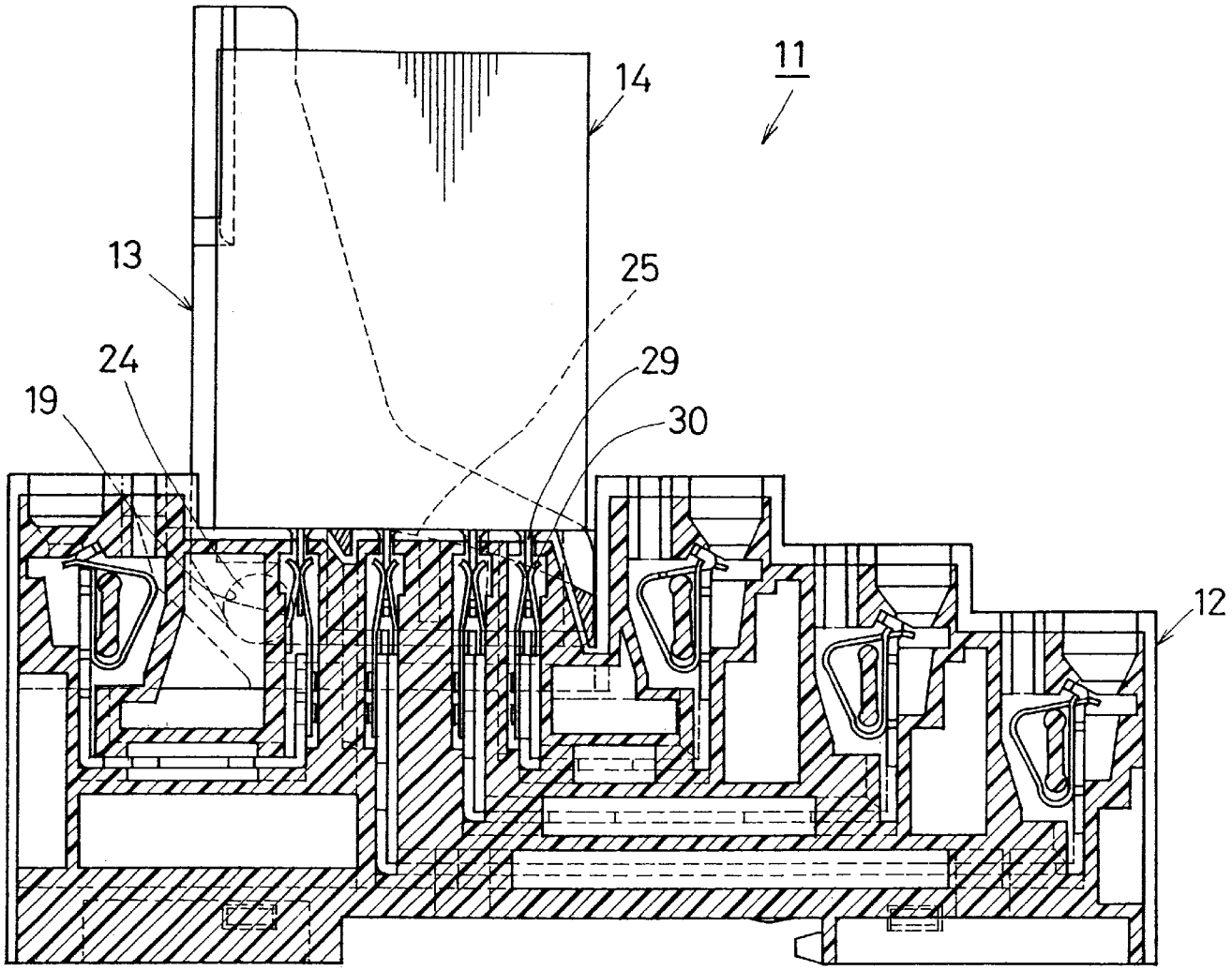
FIG. 5 is a longitudinal side section view showing the internal structure of the multipolar socket shown in FIG. 1.

An arch-like pushing-up curved face 25 which is protrudingly curved is formed on the inner face of each of the side plates 23. Each of the pushing-up curved faces 25 is formed as a narrow arcuate face which thinly elongates from the side of the journal shafts 24 to the front end side along the corresponding side plate 23. In the pushing-up curved faces 25, the position in the vicinity of the side of the journal shafts 24 is set to be higher in level so as to be used in an initial contact with the relay 14, and the front end side is set to be lower. When the relay 14 which will be described later is attached, therefore, the lower face of the relay 14 is in contact with a part of each of the pushing-up curved faces 25 which is in a higher level (FIG. 5).

When the ejector 13 is then tilted with using the journal shafts 24 as the tilting fulcrum, the relay 14 is pushed up while the contact positions of the pushing-up curved faces 25 are gradually displaced from a higher position to a lower position, thereby performing an pulling out operation.

A rectangular terminal window 26 which allows attachment and detachment of the relay 14 is formed in the center of the lower portion of the ejector 13. A pressing piece 27 for a tilting operation is protrudingly formed on one side of the upper portion of the ejector 13. When the pressing piece 27 is outward pressed by a finger in the longitudinal direction, therefore, the ejector 13 is tilted with using the journal shafts 24 as the tilting fulcrum, and the relay 14 is pushed out in accordance with the tilting.

The relay 14 is formed into a small rectangular parallelepiped which can be mounted on the socket body 12. A large number of terminals 29 constituting multi-poles downward protrude from the lower face 28 of the relay 14 (FIG. 2). The terminals 29 are downward inserted and pressed into the corresponding terminal openings 20 of the socket body 12, whereby the relay 14 is connected to the socket body 12.

Figure 4:
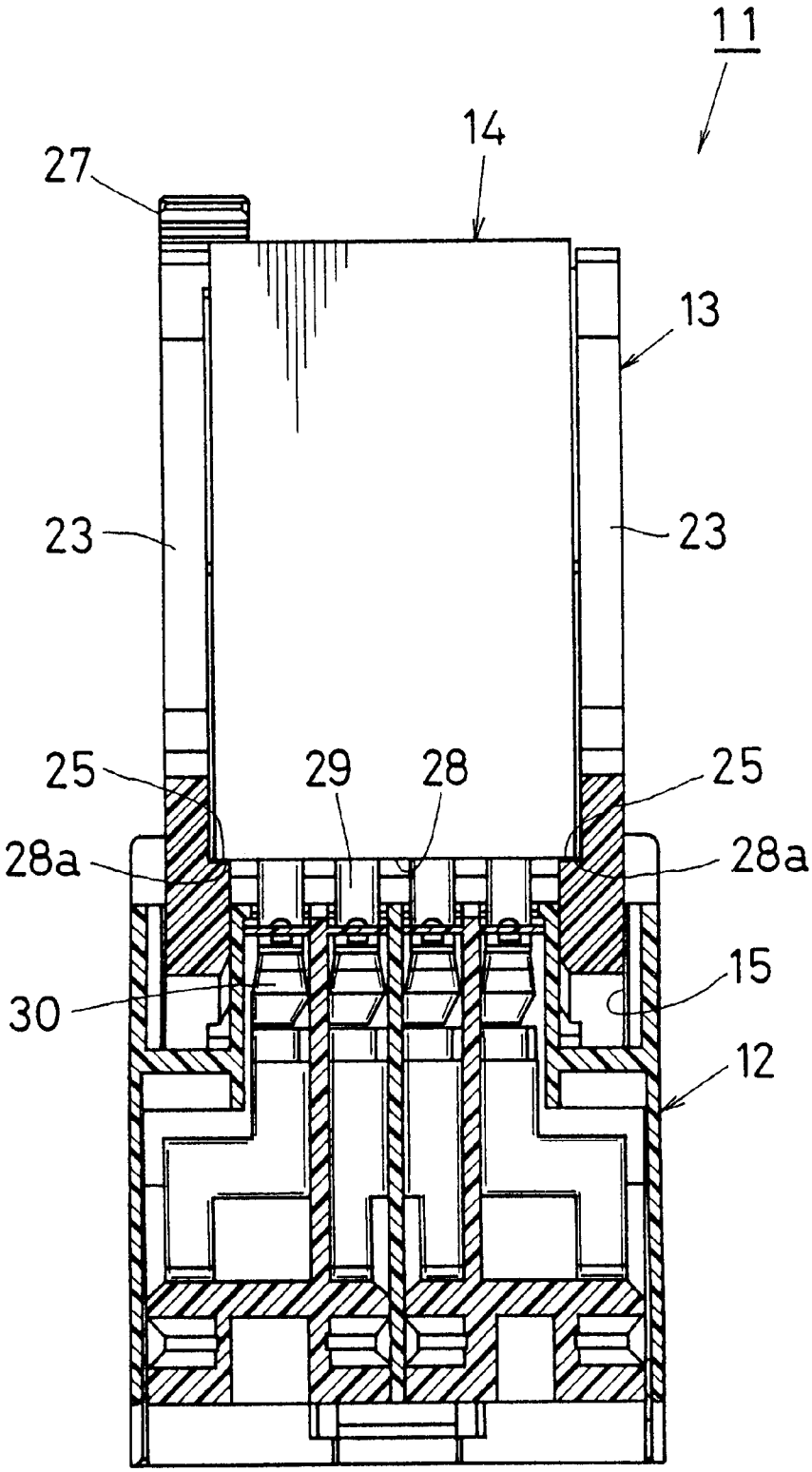
FIG. 4 is a longitudinal front section view showing the internal structure of the multipolar socket shown in FIG. 1.

At this time, as shown in FIG. 4, side edge portions 28*a* of the lower face 28 of the relay 14 are in contact with the corresponding pushing-up curved faces 25 of the ejector 13, respectively. The relay 14 is further pressed, so that the relay 14 is attached to the upper face of the socket body 12 as shown in FIG. 5.

When the relay 14 is attached to the socket body 12 via the ejector 13, as shown in FIG. 5, the terminals 29 of the relay 14 are electrically connected in a pressed manner to contacts 30 which are positioned inside the terminal openings 20, respectively. Each of the contacts 30 is of the type in which the corresponding terminal 29 is clampingly held by a pair of opposed plate springs.

Figure 3:
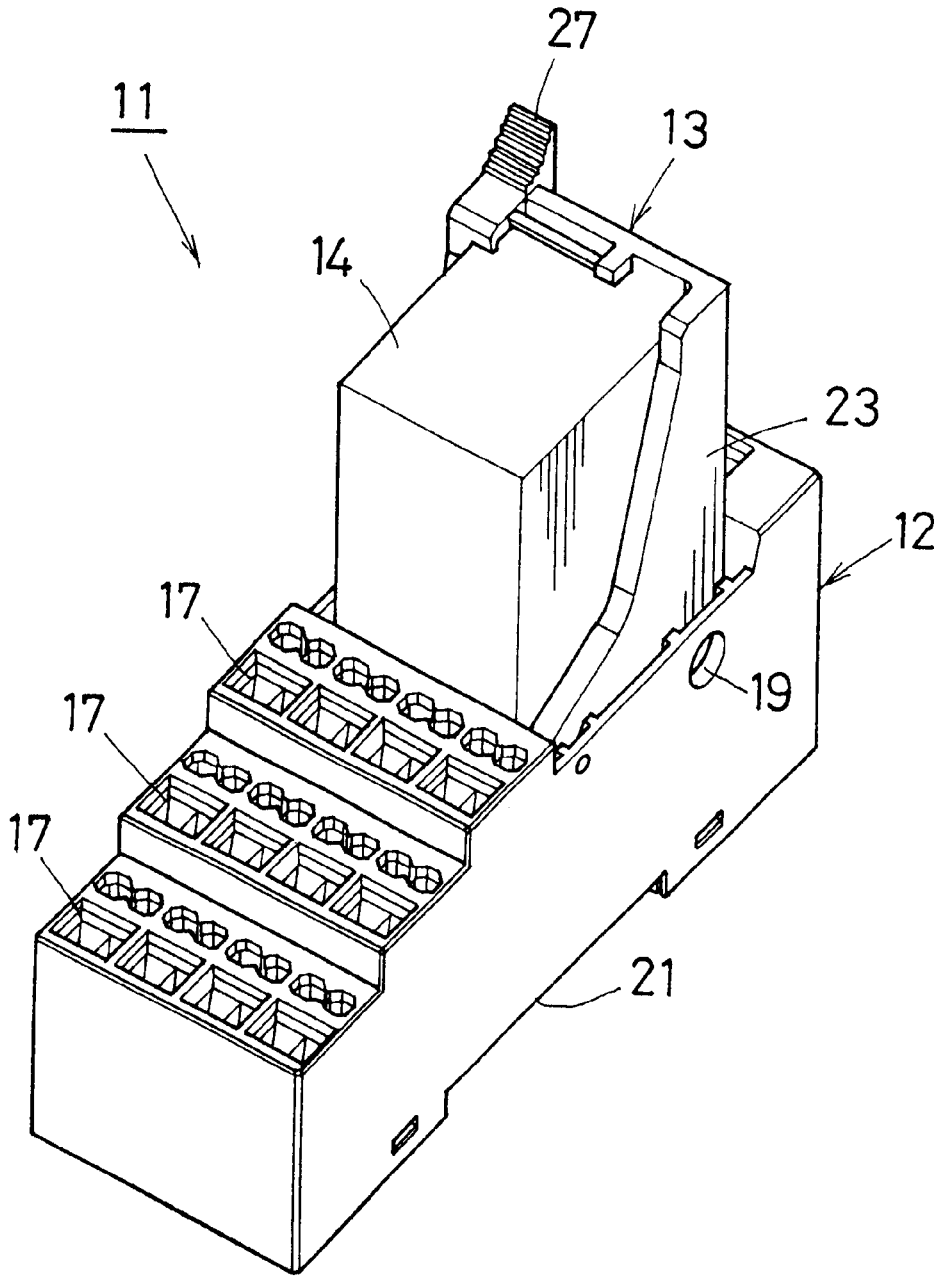
FIG. 3 is an external perspective view of the multipolar socket shown in FIG. 1 in an assembled state.
Figure 6:
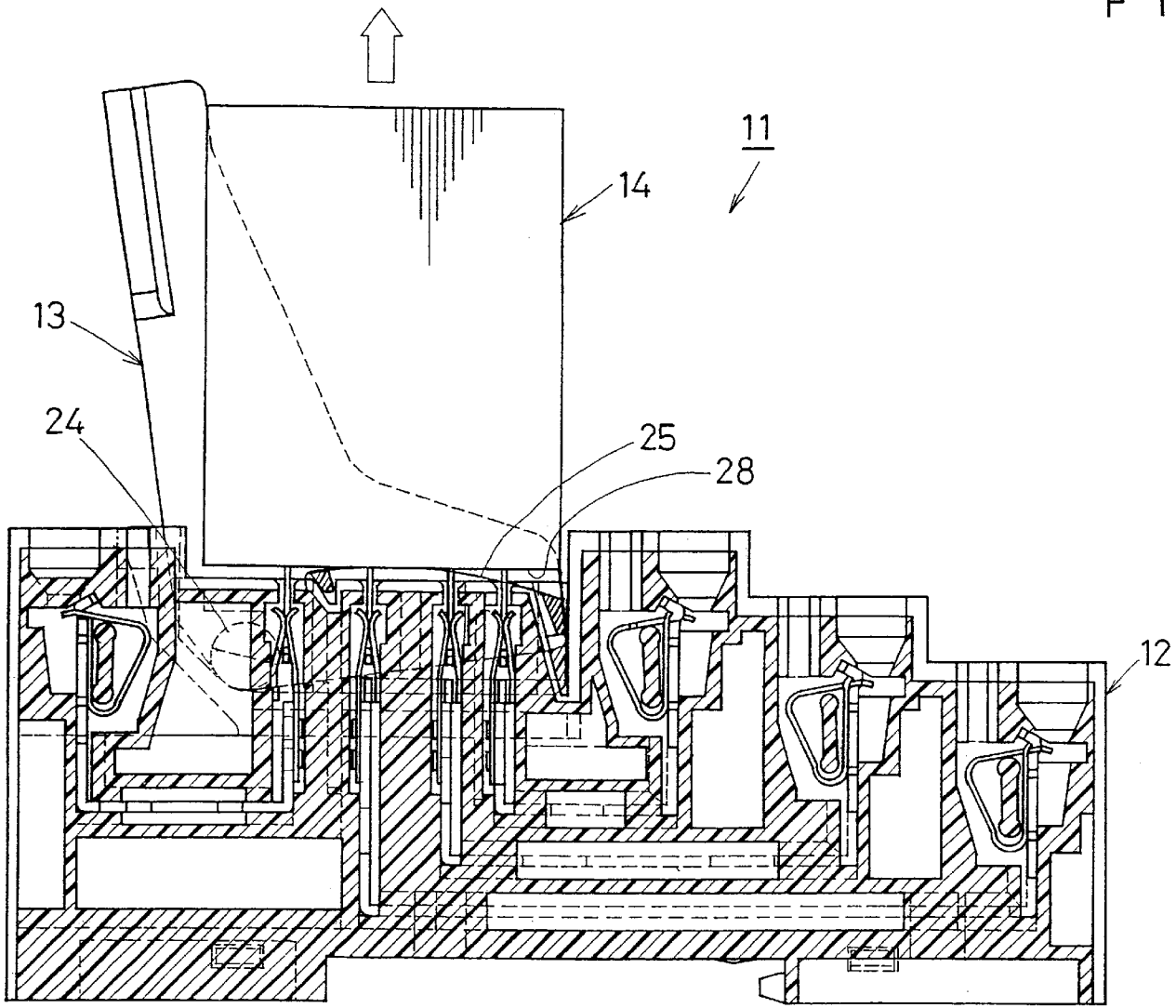
FIG. 6 is a longitudinal side section view showing the initial state of an operation of pulling out the multipolar socket shown in FIG. 1.

Usually, the multipolar socket 11 is used in a state where the relay 14 is mounted on the socket body 12 via the ejector 13 as shown in FIGS. 3 to 5. When the relay 14 is to be detached from the socket body 12 for the purpose of inspection, replacement, or the like, the worker first presses the pressing piece 27 by a finger to rearward incline the ejector 13 as shown in FIG. 6.

Figure 7:
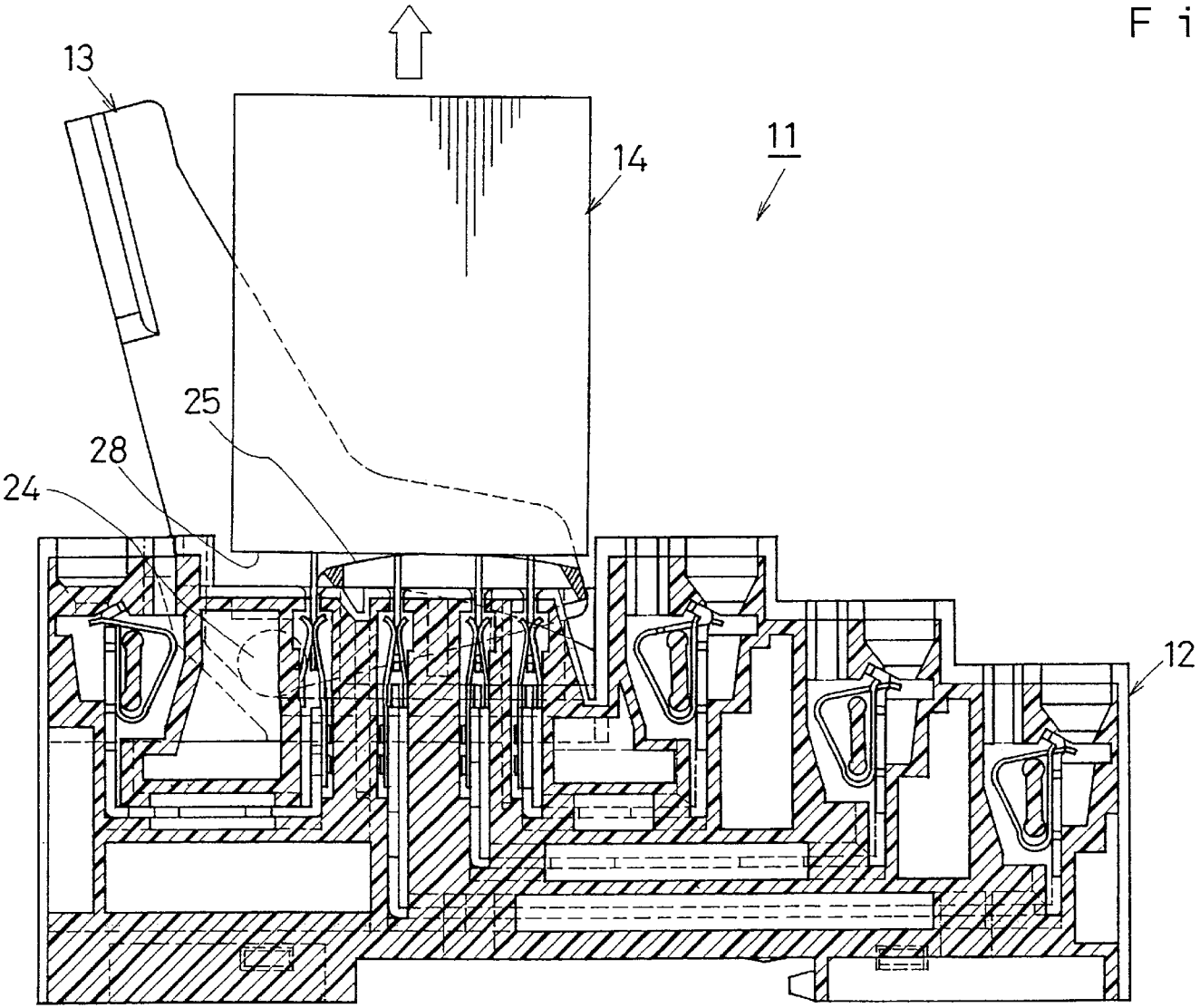
FIG. 7 is a longitudinal side section view showing the completed state of an operation of pulling out the multipolar socket shown in FIG. 1.

At this time, the pushing-up curved faces 25 of the ejector 13 which is tilted with using the journal shafts 24 as the tilting fulcrum push up the lower face 28 of the relay 14 which is in contact with the upper faces of the pushing-up curved faces. The pushing-up curved faces 25 push up the relay 14 in a straight upward direction while the contact portions are gradually displaced from a position in the vicinity of the journal shafts 24 to that remoter therefrom. As shown in FIG. 7, therefore, the contact positions between the pushing-up curved faces 25 and the relay 14 are not largely separated from a center area of the lower face 28 of the relay 14 so that the relay 14 is pushed up in the same direction as the direction of pulling out the relay. Therefore, the relay 14 is always pushed up in the vertical direction.

In this case, the tilting displacement distance of the pushing-up curved faces 25 which are operated in the form of tilting displacement is very smaller than the linear pulling displacement distance in the relay pushing-up direction. Therefore, the pulling-out direction of the relay 14 and the pushing-up direction of the pushing-up curved faces 25 can be set to substantially coincide with each other.

Moreover, the pushing-up curved faces 25 are mobilly in surface contact with the relay in accordance with the tilting, and the pulling-out angle can be always maintained to have the same value. Therefore, it is possible to obtain the ejector 13 of high durability in which the pulling-out load is not locally concentrated, and which is free from fear of breakage or the like.

Even when a large pulling-out force is required as a result of an increased number of terminals of the relay, a linear force can be kept to be applied in the same direction as the direction of pulling out the relay 14. Therefore, the relay 14 is stably pushed out in a substantially vertical direction. Particularly, stresses such as bending on the terminals can be suppressed to the minimum degree, and hence it is possible to obtain a performance of detaching the relay 14, the performance being suitable for the multipolar socket 11.

The pushing-up curved faces 25 formed on the ejector 13 are respectively disposed in the side ends which are opposed to the attachment face of the relay 14. Therefore, the single relay 14 can be pushed up in balance at the both the sides, whereby the pulling-out force can be uniformly applied to the attachment face of the relay 14.

Figure 8:
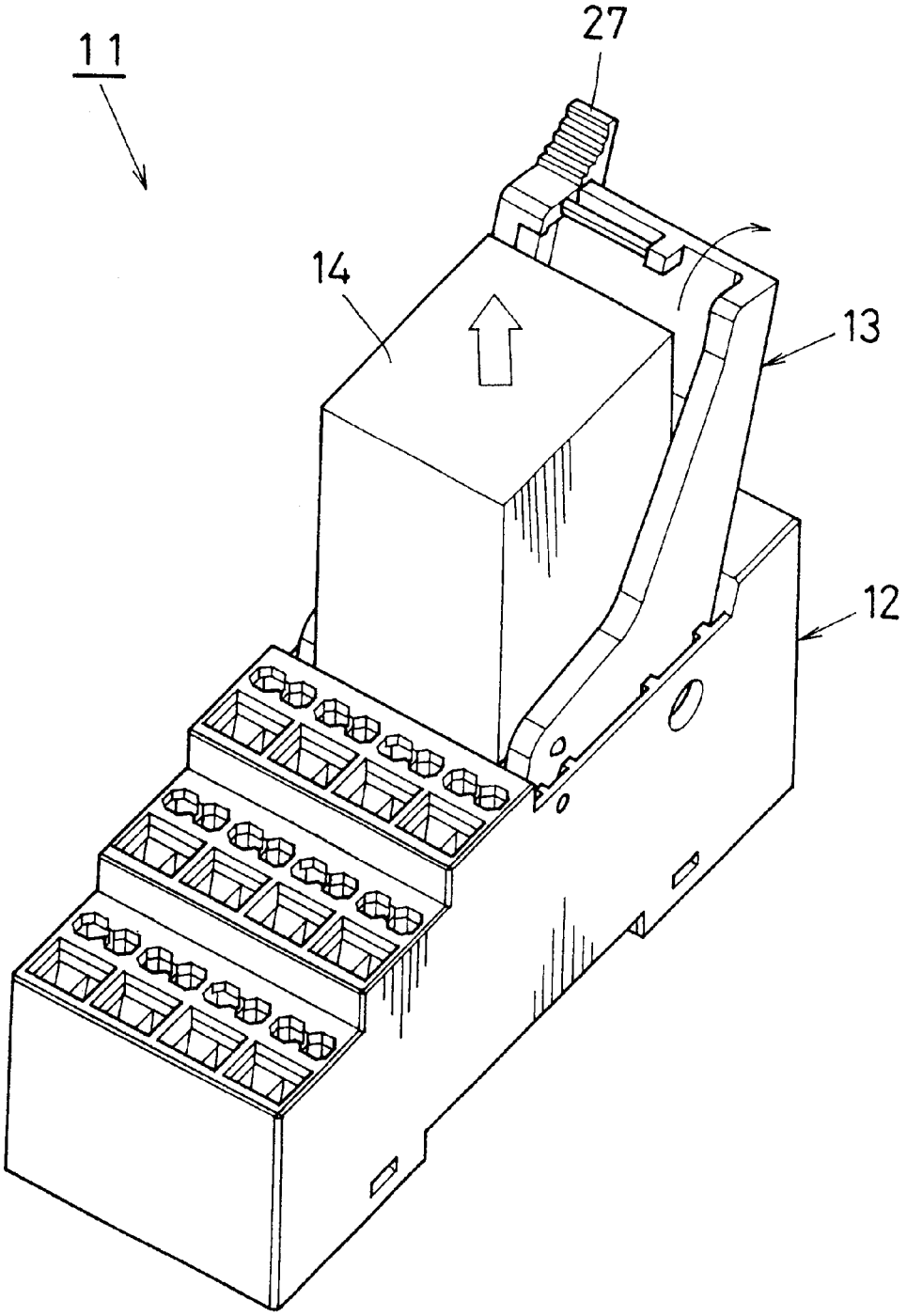
FIG. 8 is an external perspective view showing the completed state of an operation of pulling out the multipolar socket shown in FIG. 1.
Figure 9:
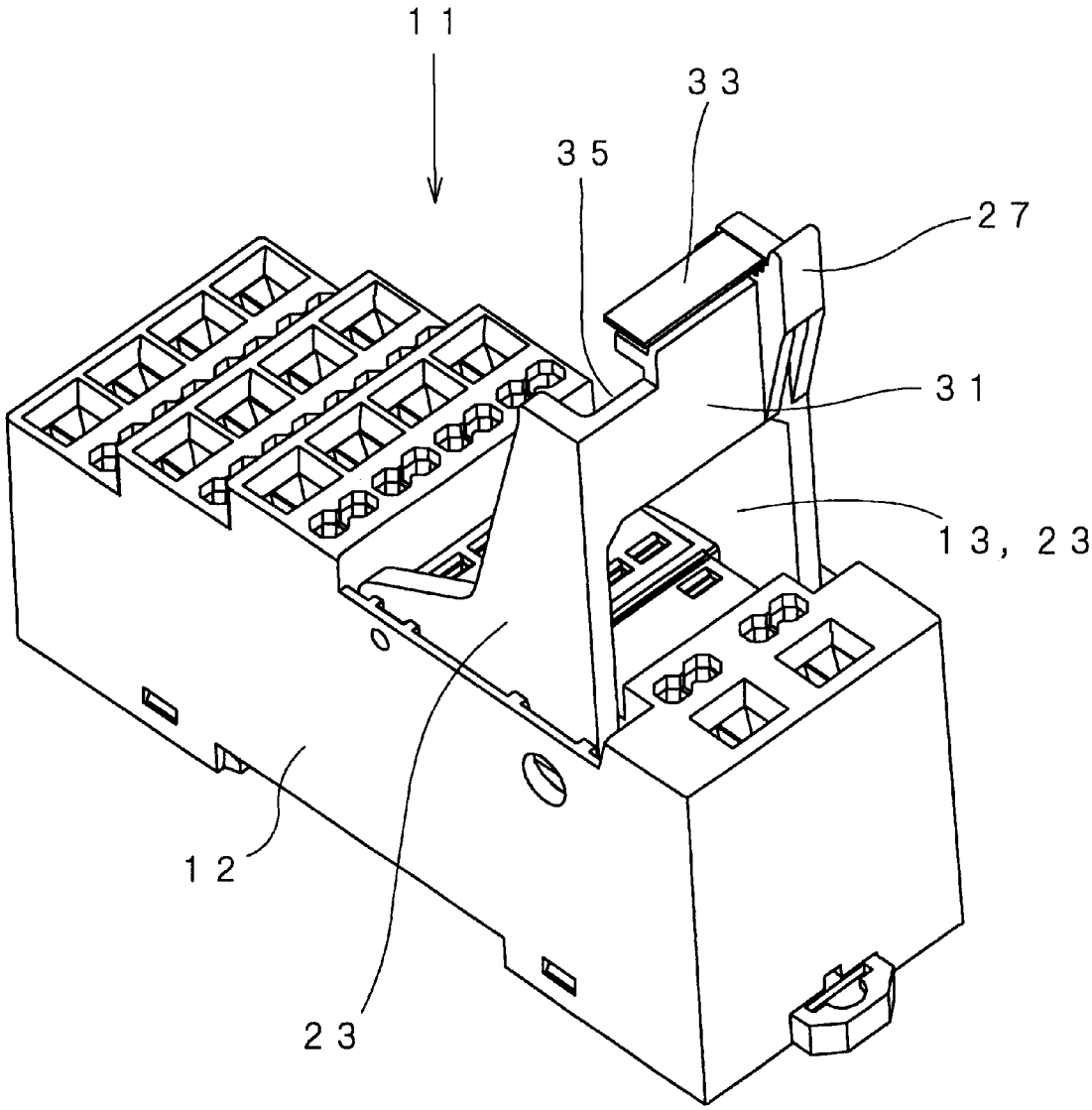
FIG. 9 is a perspective view of a multipolar socket as viewed from the top of a second embodiment of the invention.

At the timing when the ejector 13 is largely tilted as shown in FIG. 8, the terminals 29 of the relay 14 are disconnected from the contacts 30, and the relay is completely separated from the socket body 12, thereby completing the operation of pulling out the relay 14.

As described above, when the pulling-out force is applied to the relay 14 in accordance with tilting of the ejector 13, the pushing-up curved faces which correspond to the point of application of the ejector using the principle of the lever are gradually displaced so as to follow the pulling movement, even after the relay begins to be pulled out in the pulling-out direction. Consequently, the pushing-up direction of the pushing-up curved faces and the relay pulling-out direction always coincide with each other, so that a smooth pulling out operation can be ensured.

As shown in FIGS. 9 to 12, a second embodiment is approximately identical with the first embodiment described above, except that a nameplate 33 is detachably attached to the ejector 13.

Figure 10:
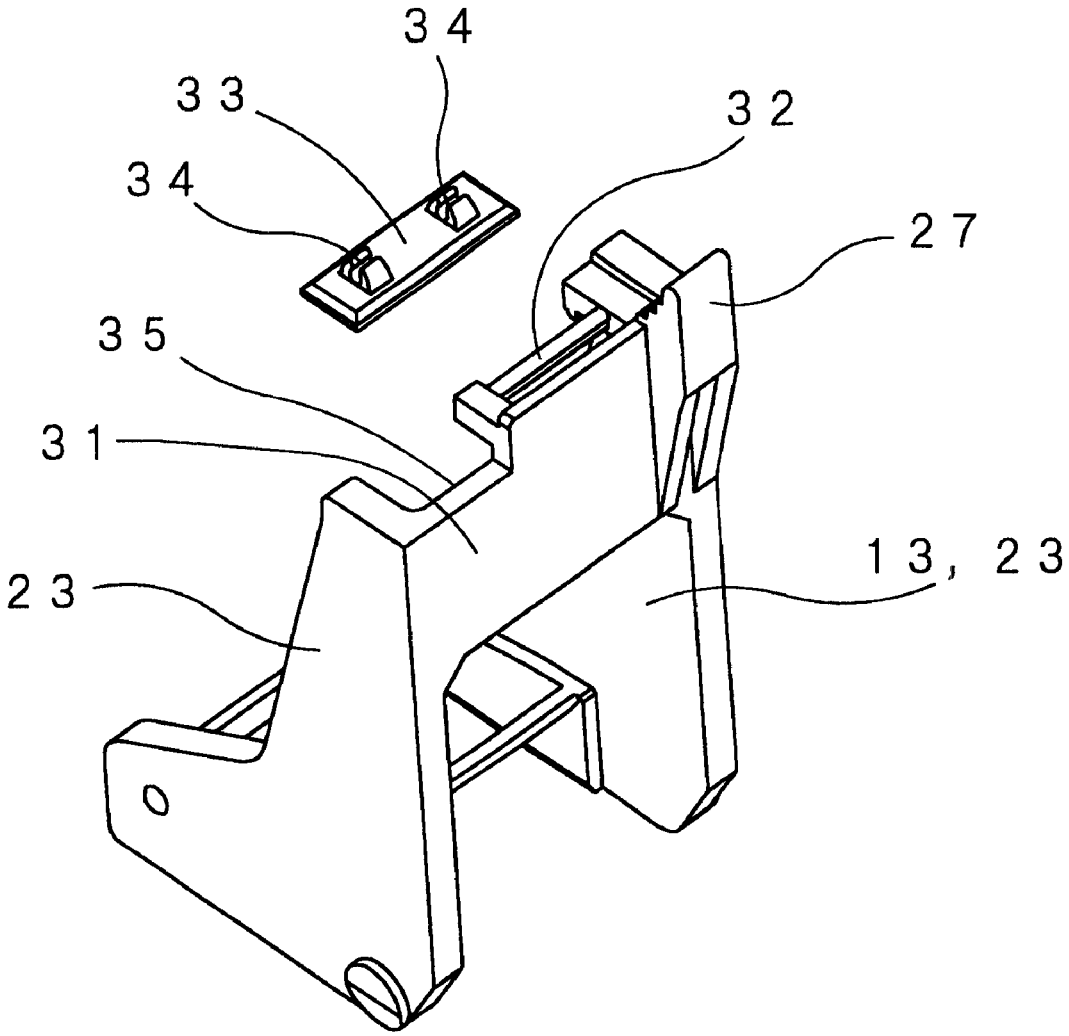
FIG. 10 is an external perspective view of an ejector shown in FIG. 9.
Figure 12:
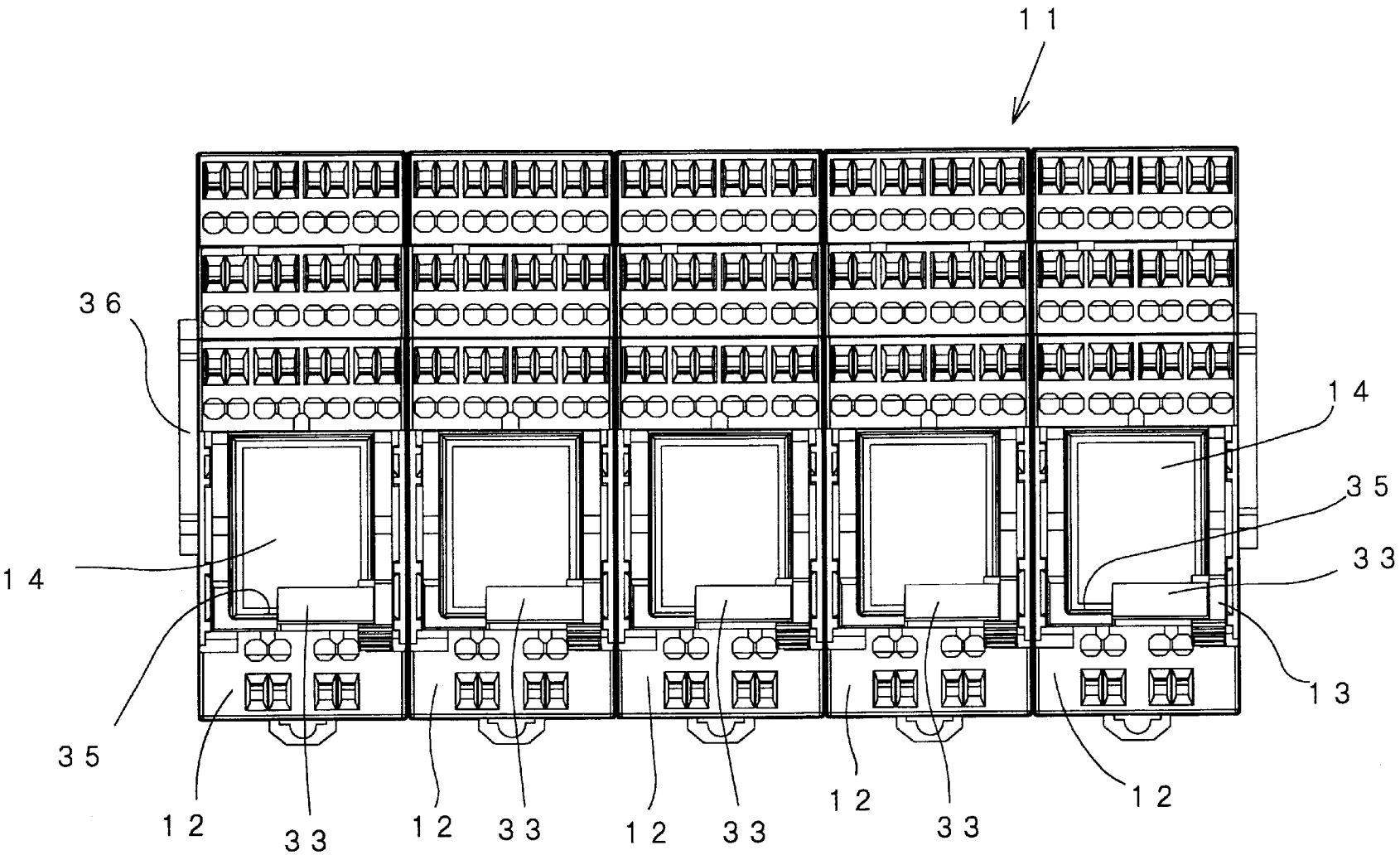
FIG. 12 is a plan view showing the use state of the multipolar socket shown in FIG. 9.

In the ejector 13, an attachment shaft 32 bridgingly elongates between a back plate 31 which extends between the side plates 23, and one of the side plates 23. The nameplate 33 is detachably attached to the attachment shaft 32. The attachment shaft 32 is elastically clamped by two sets of elastic hooks 34 which protrude from the rear face of the nameplate 23 as shown in FIG. 10, whereby the nameplate 33 is detachably attached to the attachment shaft 32. As shown in FIG. 12, a cutaway portion 35 is formed on the left side of the nameplate 33. This portion is formed in order to allow an operation indicator (not shown) of the relay 14 which is positioned immediately below the nameplate 33 to be visually checked.

Figure 11:
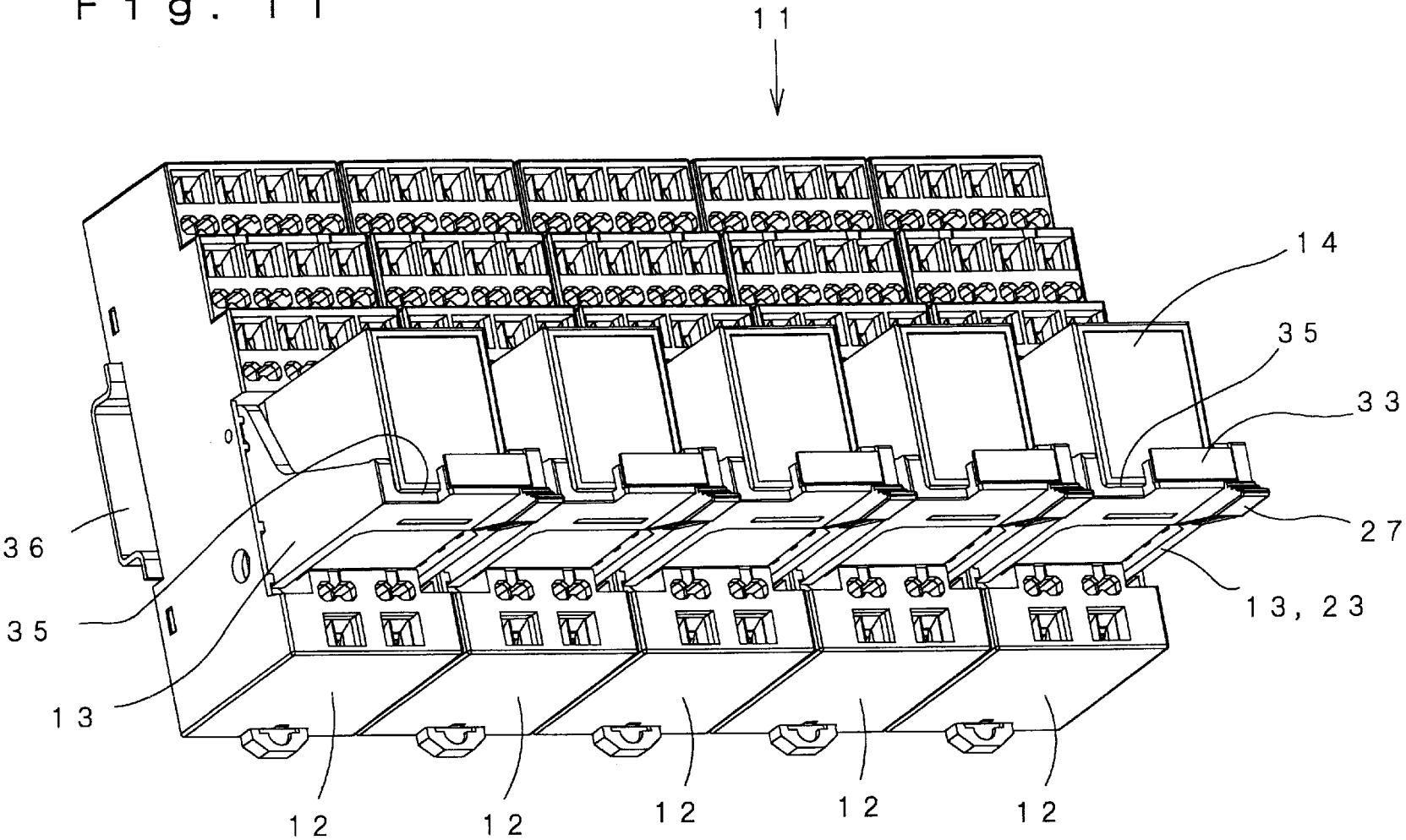
FIG. 11 is a perspective view showing the use state of the multipolar socket shown in FIG. 9.

In the configuration wherein the nameplate 33 is attached to the ejector 13, even when a large number of socket bodies 12 are attached to a guide rail 36 as shown in FIGS. 11 and 12, the relay 14 is prevented from being erroneously detached during maintenance. Also when the detached relay 14 is to be returned to the socket body 12, the relay is prevented from being erroneously attached to the socket body. Therefore, the embodiment has an advantage that maintenance can be performed easily and surely.

A similar nameplate may be attached to the top face of the relay 14. When the nameplates 33 respectively attached to the ejector 13 and the relay 14 bear the same number, erroneous attachment or the like does not occur during maintenance, thereby producing an advantage that this configuration is more convenient and safer.

Figure 13:
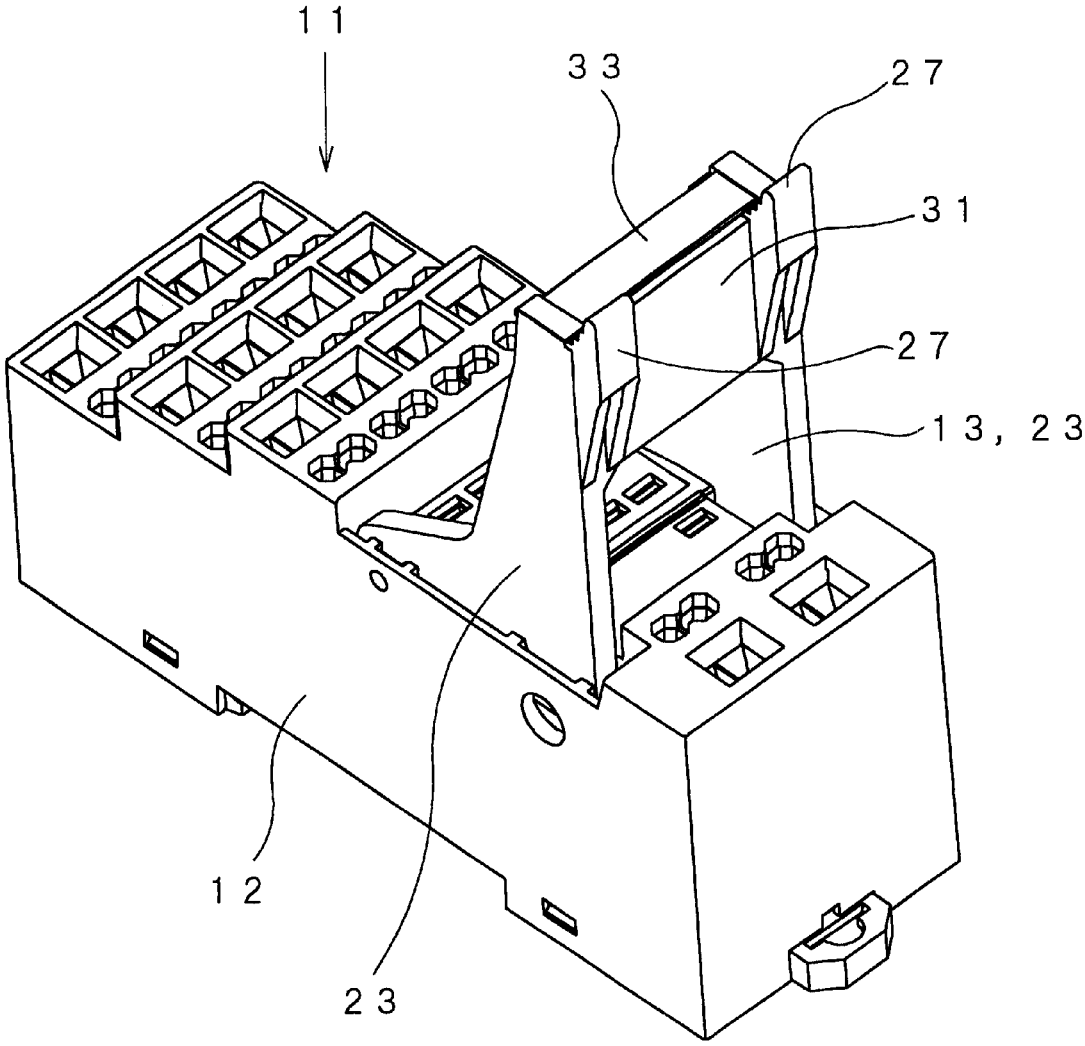
FIG. 13 is a perspective view of a multipolar socket as viewed from the top of a third embodiment of the invention.

As shown in FIG. 13, a third embodiment is approximately identical with the second embodiment described above, except that the cutaway portion is not formed in the ejector 13.

In the embodiment, the pressing piece 27 is formed on an upper end portion of each of the side plates 23. Therefore, the relay 14 can be detached by means of any one of the pressing pieces 27, so that the ejector can be conveniently used. Particularly, the relay 14 can be detached by using both the hands, with the result that an advantage that the relay 14 can be easily detached is attained. The other portions are configured in the same manner as those of the above-described embodiments, and hence their description is omitted.

Figure 14:
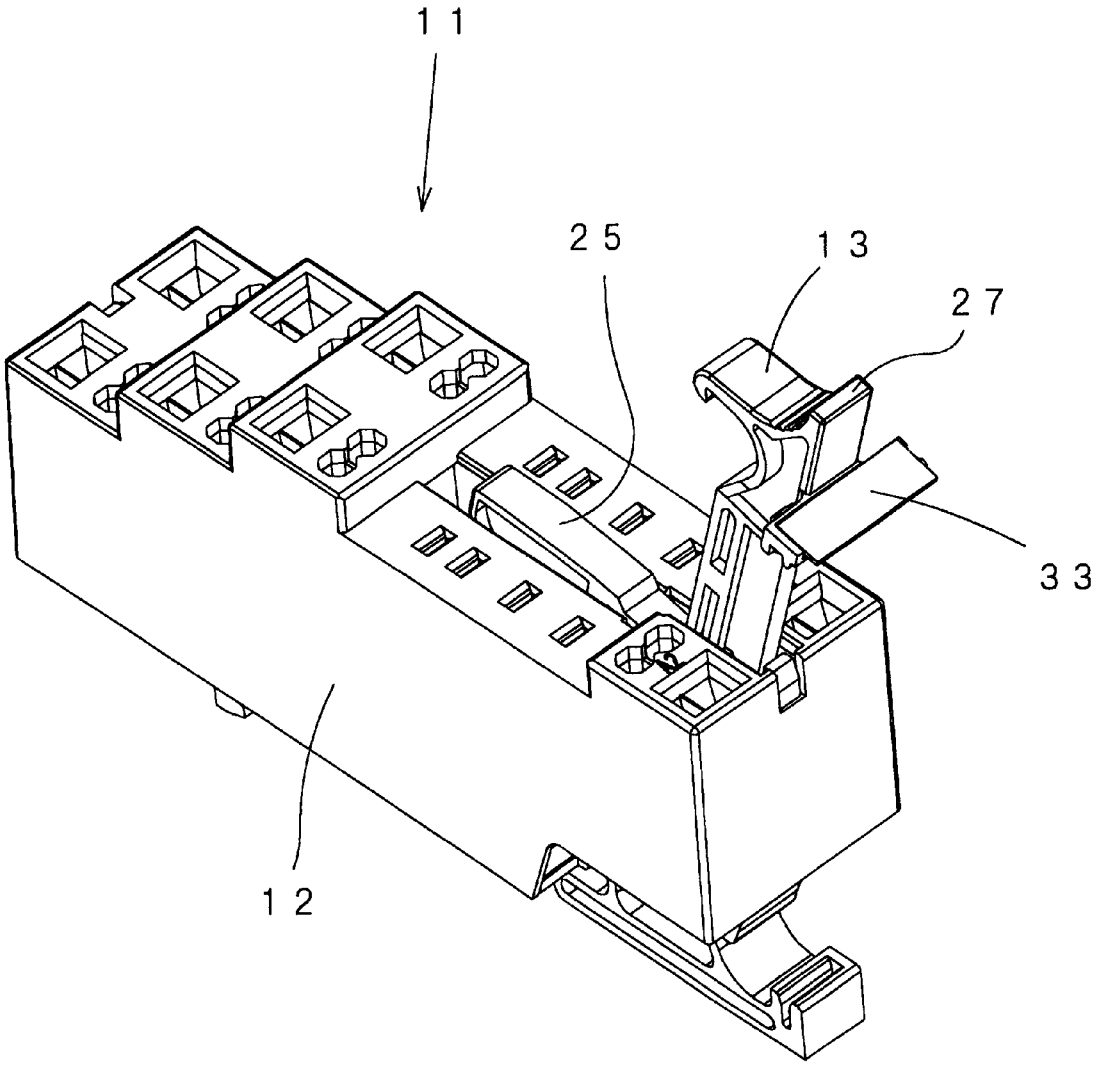
FIG. 14 is a perspective view of a multipolar socket as viewed from the top of a fourth embodiment of the invention.
Figure 15:
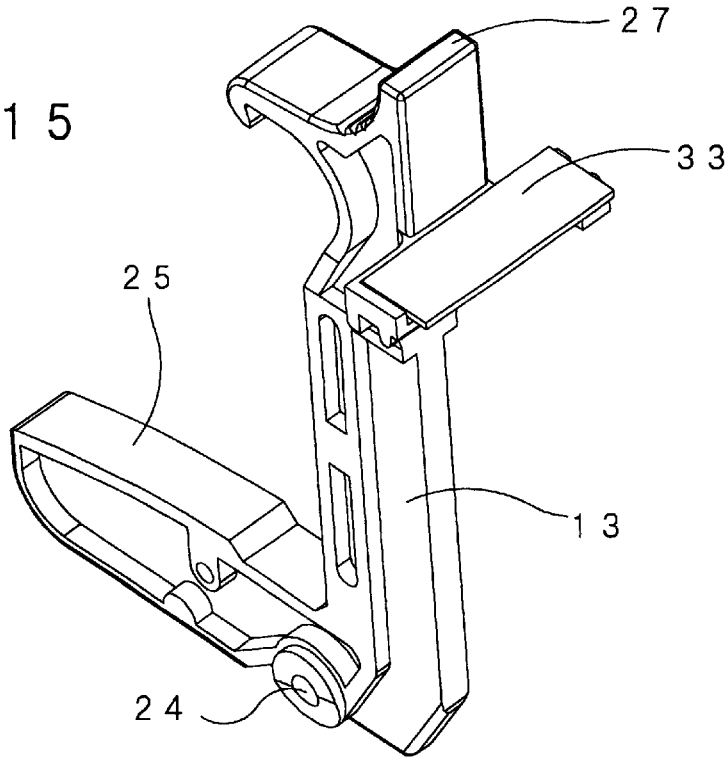
FIG. 15 is a perspective view of the multipolar socket shown in FIG. 14.
Figure 16:
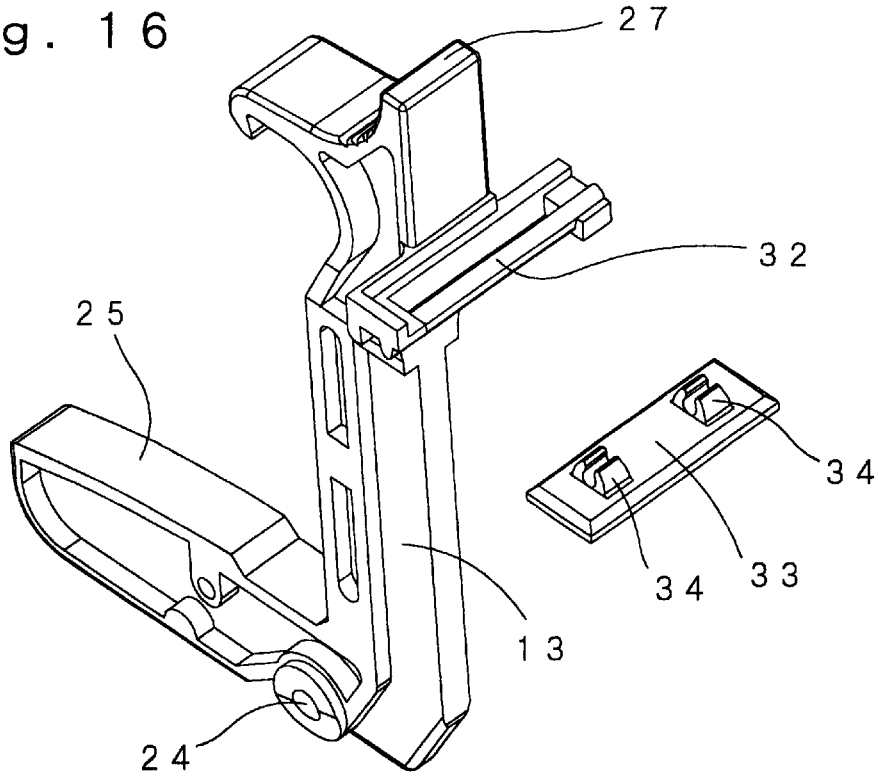
FIG. 16 is an exploded perspective view of the multipolar socket shown in FIG. 14.
Figure 17:
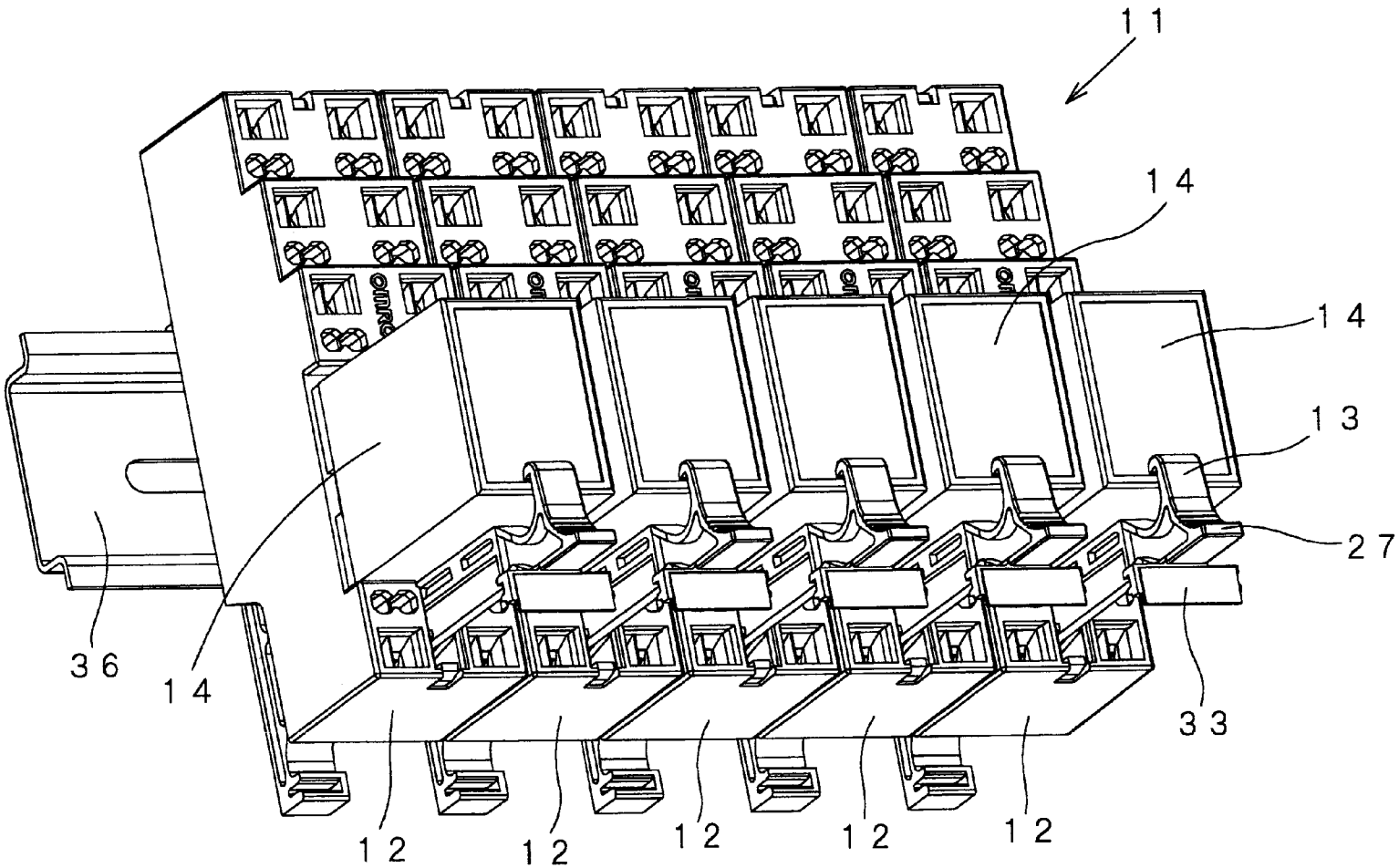
FIG. 17 is a perspective view showing the use state of the multipolar socket shown in FIG. 14.

In a fourth embodiment, as shown in FIGS. 14 and 15, the invention is applied to a multipolar socket (not shown) of two poles in contrast to the above-described multipolar sockets 12 having four poles. The identical portions are denoted by the same reference numerals.

The ejector 13 constitutes an ejector mechanism for detaching the relay 14 which is mounted on the upper face of the socket body 12. The ejector 13 has a substantially L-like shape in a front view. The pushing-up curved face 25 is formed on the horizontal upper face of the ejector 13. In the same manner as the first embodiment, the ejector 13 is configured so as to push up the relay 14. In the ejector 13, the pressing piece 27 protrudes from an upper end portion of the vertical portion, and the attachment shaft 32 is integrally formed on the back side of the pressing piece 27. The nameplate 33 which is similar to that of the second embodiment is detachably attached to the attachment shaft 32.

The position where the nameplate 33 is placed is not restricted to the back side of the pressing piece 27. For example, the nameplate 33 may be on a side of the piece in a vertically longitudinal manner.

In the correspondence relationships between the invention and the embodiments described above, the socket in the invention corresponds to the multipolar socket 11 in the embodiments, and similarly the journal portion corresponds to the journal holes 19 and the journal shafts 24. The tilting enabling means corresponds to the journal holes 19, the journal shafts 24, and the U-like accommodating groove 18 which tiltably hold the ejector 13. Therefore, the invention can be applied in accordance with the technical concept shown in the attached claims, and is not restricted to the configurations of the embodiments described above.

What is claimed is:

1. A relay socket in which a plurality of lead wires are connected to one side of an upper surface of a socket body, and a relay is attached by inserting a plurality of terminals into the other side of said upper surface, said relay being detached by pulling out from said socket body, wherein said relay socket comprises:

a roughly L-shaped ejector, said ejector having:

a pushing up curved face which is interposed between said socket body and an attachment face of said relay on one side of said ejector, and in which an arcuate face portion of the pushing-up curved face is in contact with said attachment face of said relay;

a nameplate detachably attached to a root portion of a pressing piece for tilting positioned at a tip-end portion of side of said ejector;

a journal portion, which is journalled on said socket body to serve as a tilting fulcrum at corner portions of said ejector, and which gradually displaces a contact position between said pushing-up curved face and an attachment face of said relay; and when said ejector performs a tilting operation, the contact position between said pushing-up curved face and said attachment face of said relay being moved in a pushing-up direction along which said relay is separated from said socket body using said journal portion as the tilting fulcrum, wherein the nameplate is detachably attached to said ejector so that a display surface of said nameplate and a top face of a relay face toward a same direction.

2. A relay socket according to claim 1, wherein said pushing-up curved face of an ejector is disposed in each of both sides of an attachment face of said ejector.

3. A relay socket according to claim 1, wherein the nameplate is detachably attached in proximity of an outer end portion of said ejector.

4. A relay socket according to claim 2, wherein the nameplate is detachably attached in proximity of an outer end portion of said ejector.

5. A relay socket according to claim 1 or 2, wherein the nameplate is attached to a front of the a root portion of the pressing piece for tilting of said ejector.

6. A relay socket according to claim 5, wherein the nameplate is detachably attached in proximity of an outer end portion of said ejector.

7. A relay socket according to claim 1 or 2, wherein an attachment shaft provided at the root portion of the pressing piece for tilting of said ejector is elastically clamped by at least a pair of elastic hooks protrusively provided at a back of a the nameplate, whereby said nameplate is detachably attached to said ejector.

8. A relay socket according to claim 1 or 2, wherein the nameplate is attached to the back of the root portion of the pressing piece for tilting of said ejector.

9. A relay socket according to claim 1 or 2, wherein the nameplate is attached to a side of the root portion of the pressing piece for tilting of said ejector.

* * * * *